United States Patent [19]

Stahlecker

[11] Patent Number: 4,571,933

[45] Date of Patent: Feb. 25, 1986

[54] OPEN-END FRICTION SPINNING MACHINE HAVING A PLURALITY OF SPINNING UNITS

[75] Inventor: Fritz Stahlecker, Bad Überkingen, Fed. Rep. of Germany

[73] Assignee: Hans and Fritz Stahlecker, Fed. Rep. of Germany

[21] Appl. No.: 663,690

[22] Filed: Oct. 23, 1984

[30] Foreign Application Priority Data

Nov. 9, 1983 [DE] Fed. Rep. of Germany ..... 3340435

[51] Int. Cl.[4] ..... D01H 1/135; D01H 1/241

[52] U.S. Cl. ..... 57/401; 57/78; 57/104

[58] Field of Search ..... 57/22, 78, 92, 104, 57/261, 263, 264, 400, 401

[56] References Cited

U.S. PATENT DOCUMENTS 3,981,137 9/1976 Fehrer ..... 57/401

4,362,008 12/1982 Parker et al. ..... 57/401 X 4,402,177 9/1983 Grimm et al. ..... 57/104 X

*Primary Examiner*—Donald Watkins

*Attorney, Agent, or Firm*—Barnes & Thornburg

[57] ABSTRACT

In an open-end friction spinning machine having a plurality of spinning units, each containing two friction rollers that are arranged next to one another, form a wedge-shaped gap and are drivable in the same rotational direction by means of a belt drive, a common belt drive is employed. Each spinning unit is equipped with an automatic disengaging device for disengaging the belt drive of that unit. This disengaging device contains at least one spring-loaded tension pulley holding the belt drive in the driving position. The operational position of the tension pulley is secured by means of a locking device, and the tension pulley is automatically disengaged from the drive belt when the locking device is opened.

20 Claims, 5 Drawing Figures

OPEN-END FRICTION SPINNING MACHINE HAVING A PLURALITY OF SPINNING UNITS

BACKGROUND AND SUMMARY OF THE INVENTION

This invention relates to an open-end friction spinning machine having a plurality of spinning units. Each spinning unit has two friction rollers that are arranged next to one another, form a wedge-shaped yarn forming gap and are driveable in the same rotational direction by means of a belt drive. Each spinning unit also has a feeding and opening device for the fiber material to be spun, at least one suction device aimed into the wedge-shaped gap and a withdrawal device for withdrawing the spun yarn from the wedge-shaped gap.

In the case of one single spinning unit, it is known to interrupt the continuous feeding of fiber material after a yarn breakage without disengaging the drives of other elements, such as a joint drive for the two rollers. It happens frequently, however, in the case of yarn breakage, that fiber or fiber residues still remain in the region of the wedge-shaped gap. These fibers continue to be twisted together without being withdrawn from the region of the wedge-shaped gap. The result is a very hard, yarn-type structure that creates a danger of damage to the rollers and/or their bearings, such as the deformation of the surface portions of the rollers.

One objective of this invention is to equip an open-end friction spinning machine having a plurality of spinning units with an operationally effective drive for the rollers that is as simple as possible. Another objective is to make it possible to disengage this drive at one single spinning unit without impairing the drive of the adjacent spinning units.

These objectives are achieved by providing a joint belt drive for at least those spinning units that are arranged on one machine side, and by equipping each spinning unit with means for disengaging the belt drive from that spinning unit. The disengaging means comprise at least one spring-loaded tension pulley holding the belt drive in the driving position, and locking means for locking the pulley in a position wherein the pulley holds the belt drive in the driving position. When the locking means is unlocked, the tension pulley automatically moves into an inoperative position wherein the belt drive is released from the driving position.

The use of a joint belt drive for the rollers of the spinning units of at least one side of the machine results in a simplification of the whole open-end friction spinning machine. By using one or more tension pulleys in the area of each spinning unit with the operational position of the tension pulleys being secured by locking means, it is possible to open only one of the locking devices and thereby disengage the drive at only one single spinning unit, without interferring with the belt drive of adjacent spinning units. The locking means is designed such that opening requires no special expenditure of force. In this way the opening of the locking means and thus disengaging of the drive can be carried out simply and rapidly.

According to an advantageous aspect of preferred embodiments of the invention, it is provided that the locking means is connected to a yarn guard in such a way that the locking means opens when activated by the yard guard. This ensures that when yarn breakage occurs, the drive of the rollers of the corresponding spinning unit will be interrupted immediately so that danger of damage to the spinning unit is avoided.

According to another advantageous aspect of preferred embodiments of the invention, each spinning unit is provided with a locking lever connected to the tension pulley that can be operated from an exposed side. The locking lever is brought into a locking position and secured in the locked position by a locking means. A source of potential energy is connected to the locking even in such a manner that upon opening the locking means, energy will be released so as to move the locking lever into a position which in turn forces the connected tension pulley into a disengaged position. The source of potential energy may be for example a spring means attached to a frame and in a high energy configuration. For the disengagement of the drive, only the locking means need be actuated and only by a relatively small force, wherein the source of potential energy will then supply a force that is sufficient to disengage the belt drive. It is especially advantageous to employ as the locking device, an electric control element, especially a switching magnet, which preferably moves transversely to the direction of motion of the locking lever. This electric control element therefore does not act directly against the force of the energy accumulator so that it does not require excessive switching forces itself.

According to another advantageous aspect of preferred embodiments of the invention, a locking lever is connected through a transmission mechanism with a holder carrying a tension pulley such that, after opening of a locking means the locking lever is moved by a source of potential energy and in turn moves the holder with the tension pulley into an inoperative position. In this arrangement it is contemplated by means of a transmission mechanism to direct the forces of the potential energy source and of the spring element loading the tension pulley in the operational position such that they do not directly oppose one another.

In certain preferred embodiments of the invention a tangential belt moving in the longitudinal direction of the machine is provided as the belt drive for the rollers. Such a tangential belt requires the minimum number of individual parts for the individual spinning units as well as for the drive. In this case, it is particularly advantageous that the tangential belt runs along directly in contact with the surface portions of the rollers. As a result, the rollers are driven by the tangential belt directly at the desired speed without the occurrence of any multiplication. It is also particularly advantageous that the axis of rotation of the tension pulley be parallel to the axes of rotation of the two roller and be arranged in the plane which bisects the wedge-shaped gap between the two rollers. This arrangement has the advantage that by means of a single tension pulley, the tangential belt is loaded evenly in the area of the two rollers. It is advantageous for the holder of the tension pulley to be provided with a lift-off roll which, with respect to the tangential belt, is arranged on the side opposite the tension pulley. By means of this lift-off roll, the tangential belt is lifted off the rollers so that is is totally removed from the surface of the rollers.

According to another advantageous aspect of preferred embodiments of the invention, each spinning unit is provided with valve means which can shut off or apportion a vacuum source in the area of the wedge-shaped gap. It is advantageous to actuate the valve controlling the vacuum source when a yarn breakage occurs for the purpose of turning off the vacuum, thus preventing more fibers from being transported into the area of the wedge-shaped gap. To apportion the effect of the vacuum source is especially advantageous when a subsequent yarn piecing process is carried out because it can be used to control the yarn forming process during the piecing operation.

In order to interrupt the vaccum source as well as stop the rollers, the valve is arranged and/or the locking lever is constructed in such a way that the valve is actuated by movement of the locking lever caused by the opening of the locking device.

According to another advantageous aspect of preferred embodiments of the invention, a movable servicing apparatus is provided that can be applied to a spinning unit in need of servicing, said apparatus containing means for returning the locking lever of this spinning unit into the locking position. Such a servicing apparatus, which is provided for carrying out a fully automatic yarn piecing process, has the capability of putting the source of potential energy back into a high energy configuration, thus restoring the operational position of the belt drive of the rollers of the corresponding spinning unit at a suitable point in time during the yarn piecing process. If, by means of a mechanical control, the vacuum source is turned off and the drive of the rollers is disengaged simultaneously due to a yarn breakage, it is necessary to return the locking lever very early during the piecing process into its operational position. In order to control the drive during the piecing process by means of the servicing apparatus, it is advantageous if the servicing apparatus is equipped with means for interrupting the driving effect of the belt drive at a spinning unit. It is also advantageous if the servicing apparatus is provided with an auxiliary drive for the rollers that can be applied to the rollers of a spinning unit. By means of this auxiliary drive, the rollers can be driven at a speed that is particularly suitable for yarn piecing. It is also expedient if the servicing apparatus is provided with means for actuating the valve of the vacuum source of a spinning unit. It thus becomes possible to switch off the suction effect during the piecing process and/or apportion it in such a way that suitable conditions exist for a yarn piecing process. For carrying out a yarn piecing process, it is also advantageous if the servicing apparatus is provided with an auxiliary drive that can be applied to the feeding and opening device of a spinning unit. It thus becomes possible, with the servicing apparatus, to apportion the feeding of the fiber material during the piecing process at a suitable ratio to the speed of the rollers, to the suction effect of the vacuum source, and to the withdrawal speed.

Further objects, features, and advantages of the present invention will become more apparent from the following description when taken with the accompanying drawings which show, for purposes of illustration only, embodiments constructed in accordance with the present invention.

DETAILED DESCRIPTION OF THE DRAWINGS

Figure 1:
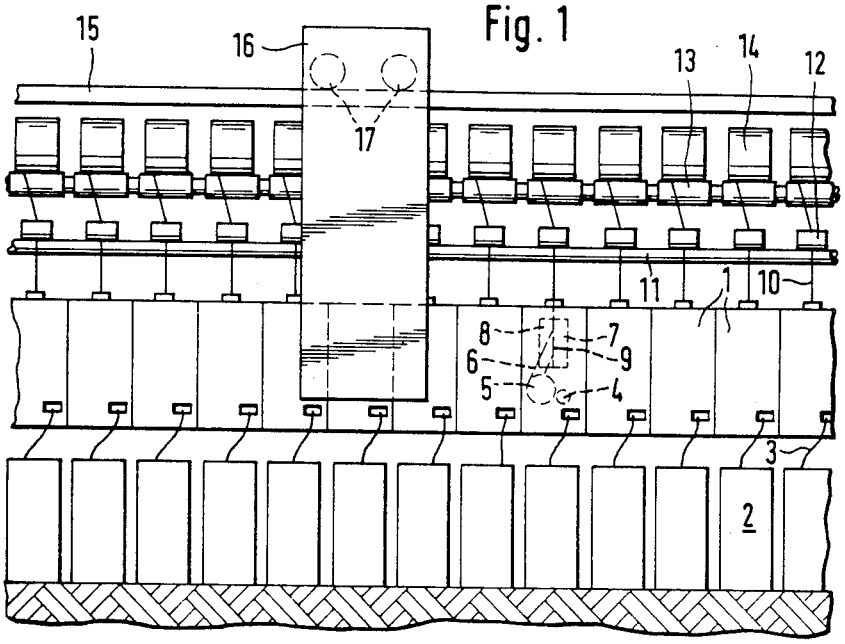
FIG. 1 is a front view of a part of an open-end friction spinning machine having a movable servicing apparatus constructed in accordance with a preferred embodiment of the present invention.

The open-end friction spinning machine according to FIG. 1 has a plurality of spinning units that are arranged next to one another in a row. Preferably, the open-end friction spinning machine is provided on both sides with spinning units 1 in the same manner. A sliver 3 is fed to each spinning unit 1 from a can 2. The sliver 3 is pulled into each spinning unit 1 by means of a feeding roller 4 which interacts with a feeding table, not shown in the drawings, and offers the sliver 3 to a faster opening roller 5. The circumference of opening roller 5 is provided in a known manner with fittings, and this roller opens up the sliver 3 up into individual fibers. The individual fibers are led by a fiber feeding duct 6, to the area of a wedge-shaped gap 9 formed by two rollers 7 and 8 that are arranged next to one another and are drivable in the same rotational direction. From the wedge-shaped gap 9, the spun yarn 10 is withdrawn by a withdrawal device in the longitudinal direction of the wedge-shaped gap 9. The withdrawal device consists of a driven cylinder 11 moving in the longitudinal direction of the machine and a pressure roller 12 pressed against the cylinder 11. Each spinning unit 1 is provided with such a pressure roller 12. The yarn 10 is subsequently wound on a wind-up spool 14 which rests on, and is driven by, a grooved drum 13.

The open-end friction spinning machine is provided with rails 15 on which an automatic servicing apparatus 16 moves by means of running wheels 17 of which at least one is driven. This servicing apparatus 16 can be applied to a single spinning unit 1 in need of servicing and is used for carrying out a fully automatic yarn piecing process after a yarn breakage at one individual spinning unit.

Figure 2:
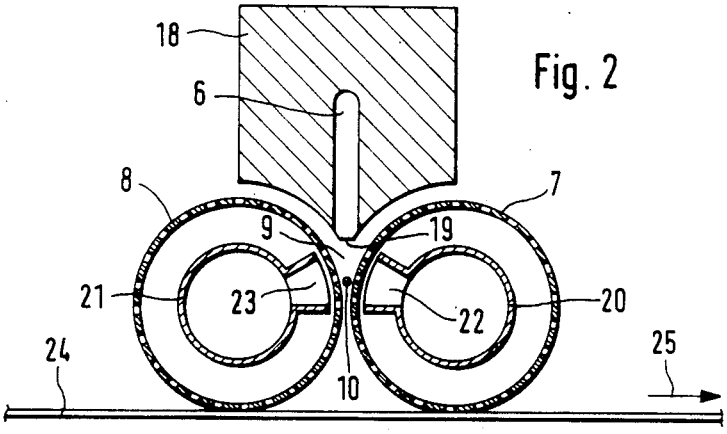
FIG. 2 is an enlarged partial sectional view of an individual spinning unit with which the present invention is used.
Figure 3:
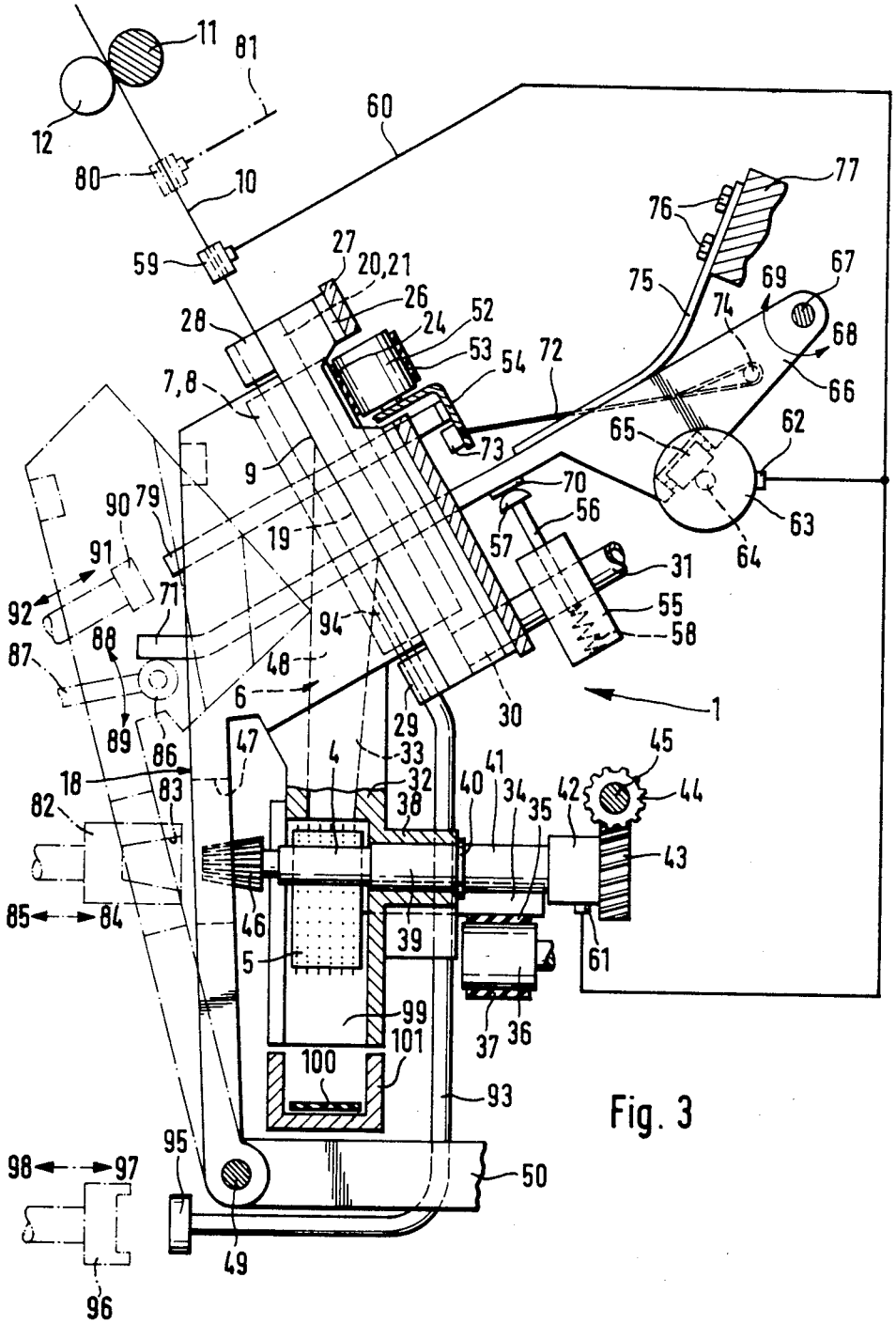
FIG. 3 is an enlarged, partially sectional lateral view of an individual spinning unit, whose rollers are driven by means of a tangential belt and which is provided with means for interrupting the drive of the rollers constructed in accordance with a preferred embodiment of the invention.

As shown in FIG. 2 the two rollers 7 and 8 are arranged in parallel next to one another and have perforated surfaces. Suction inserts 20 and 21 are located in the interior of each roller, and are provided with suction slots 22 and 23 aimed at the area of the wedge-shaped gap 9 and delimited by webs projecting to the inside surfaces of the rollers 7 and 8. Through these suction slots 22 and 23, a vacuum is generated in the area of the wedge-shaped gap 9. The suction created by the vacuum extends into the fiber feeding channel 6 which, with its mouth 19, is opposite the wedge-shaped gap 9. By means of this suction, the fibers are transported to the surfaces of the rollers 7 and 8 and the forming yarn 10 is held in the tapering area of the wedge-shaped gap 9. The yarn is then withdrawn in the longitudinal direction of the wedge-shaped gap 9. The cylindrical surfaces of the rollers 7 and 8 are disposed by means of roller bearings on the tube-shaped suction inserts 20 and 21. The suction inserts 20 and 21 rise above the rollers 7 and 8 on both front sides and are clamped tight by means of tool holders 28 and 29 at a bearing housing 26 which itself is fastened at a support 27 of the machine frame as shown in FIG. 3. The suction inserts 20 and 21 are closed on the front side by ducts 30 of the roller housing 26 and are connected to vacuum pipes 31 leading to a central vacuum source. In this manner, a vacuum is produced within suction inserts 20 and 21. As shown in FIG. 2, the drive of the rollers 7 and 8 is effected by means of a tangential belt 24 moving in the direction of the arrow 25 in the longitudinal direction of the machine. This belt drives the rollers 7 and 8 of all spinning units 1 of one side of the machine. The tangential belt 24 runs along in direct contact with the surfaces of the rollers 7 and 8 and drives both rollers in the same direction. The roller housing 26 as shown in FIG. 3 is provided with a notch in the area of the tangential belt 24. The tangential belt 24 is pressed against the surfaces of the rollers 7 and 8 by means of a tension pulley 52. The axis of rotation of the tension pulley 52, which also returns end 53 of the tangential endless belt 24, is arranged in the plane which bisects the wedge-shaped gap 9. This pulley is positioned on the side that is opposite the fiber-bearing side. In other words, the axis of rotation of tension pulley 52 is located in the plane which bisects the wedge-shaped gap 9 and which extends perpendicularly through the plane containing the two axes of the rollers 7 and 8, said plane bisecting the wedge-shaped gap being parallel to tangents to both rollers 7 and 8.

The feeding roller 4 of each spinning unit 1 is arranged on a shaft disposed in a cylindrical tube 39. This shaft is connected to a worm wheel 43 through a coupling 42 with a toothed wheel 44 that is arranged on a shaft 45 which is driven continuously and is arranged longitudinally within the machine. The tube 39 is disposed firmly on the machine in a conventional manner which need not be described further herein. Through an electric connection 61 and an electric line 60, the coupling 42 is connected with a yarn guard 59 arranged in front of withdrawal means 11 and 12. At the time of a yarn breakage, the coupling 42 is opened so that the feeding roller 4 is stopped and feeding of the sliver is interrupted.

The opening roller 5 of each spinning unit 1 is arranged in an opening roller housing 32, which by means of a fitting strip 38, is fitted onto the tube 39 and is supported in the axial direction against a ring collar 40 of the tube. The shaft 34 of the opening roller 5 projects out of the fitting strip 38 and is driven by a tangential belt 35 moving in a direction longitudinal of the machine. The tangential belt 35 is loaded in the area of each spinning unit 1 by means of a tension pulley 36 on which the returning end 37 of the tangential belt 35 is guided. The opening roller housing 32 is provided with a parting opening 99 starting at the circumference of the opening roller 5 and being open in the direction of a trough-shaped channel 101. A transport belt 100 that passes by all spinning units 1 runs in the channel 101 in a longitudinal direction relative to the machine. This transport belt 100 removes parted dirt and residues. A first portion 33 of the fiber feeding channel 6 starts at the circumference of the opening roller 5 at a distance from the parting opening 99. The feeding channel continues as a second portion 48 containing the mouth 19 which is opposite the wedge-shaped gap 9. The tangential feeding channel 6 which starts at the opening roller 5 and comprises portions 33 and 48 is located approximately in the plane which bisects the wedge-shaped gap 9. The second portion 48 of the fiber feeding channel 6 is a component of a housing part 18 that can be swivelled around a shaft 49 located below the feeding and opening device. The housing part 18 may be swivelled away into the dash-dotted position for exposing the wedge-shaped gap 9. The shaft 49 is mounted on holders 50 of the machine frame. In the area of the mouth 19 of the portion 48 of the fiber feeding channel 6, a suction duct 94 is positioned on the side facing away from withdrawal means 11 and 12. This suction duct 94 is connected by means of a suction pipe 93 with a suction connection 95 on the front side of the spinning unit 1. Through movement in the direction of the arrows 97 and 98, a suction connection 96 of the servicing apparatus 16 can be connected to the suction connection 95. The suction connection 96 of the servicing apparatus 16 produces a vacuum in the suction duct 94 for the yarn piecing process, by means of which a yarn end for the piecing process can be drawn back into the opened or closed spinning unit 1.

Figure 4:
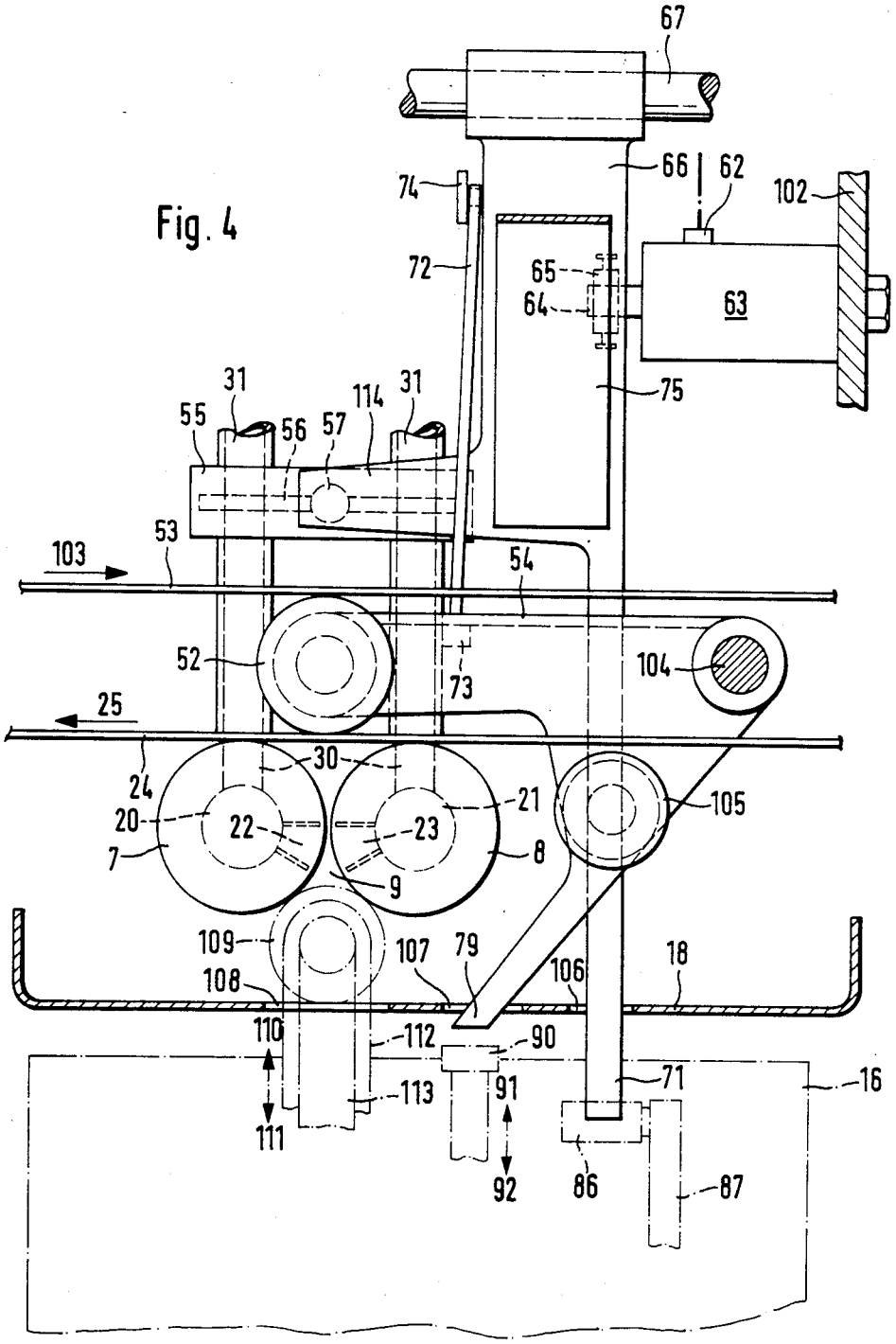
FIG. 4 is a top view of the spinning unit of FIG. 3, with certain components removed for illustration purposes.

As already mentioned, the feeding of the sliver 3 is interrupted by the opening of the coupling 42 when the yarn guard 59 senses a yarn breakage. It is also provided that the drive of the rollers 7 and 8 is interrupted. The opening roller 5, on the other hand, continues in an uninterrupted manner. For disengaging the drive of the rollers 7 and 8, it is provided that the tension pulley 52 is moved away from the rollers 7 and 8 so that the tangential belt 24 is disengaged. Preferably, it is also provided that the tangential belt 24 is also lifted off the rollers 7 and 8 by means of a lift-off roll 105 as shown in FIG. 4. The tension pulley 52 is arranged on a holder 54 that can be swivelled around a shaft 104 extending in parallel relation to the shafts of the rollers 7 and 8. The holder 54, in a conventional manner that need not be described further herein, is loaded by a spring, such as a torsion spring arranged in the area of the shaft 104. By means of this torsion spring, the tension pulley 52 is pressed into the operational position in the wedge-shaped gap 9 between the two rollers 7 and 8 and against the tangential belt 24. On the side of the tangential belt 24, opposite the tension pulley 52 the lift-off roll 105 is mounted at the holder 54. At a distance from the shaft 104, a tension strip 72 is linked to the holder 54 at a linkage point 73. The other end of this tension strip 72 is linked to a linkage point 74 on biased locking lever 66. The locking lever 66 is disposed so that it can be swivelled in the direction of arrow 68 and 69 shown in FIG. 3 around a shaft 67 extending longitudinally relative to the machine, i.e., extending transversely to the shaft 104. The linkage pint 74 on the locking lever 66 is selected in such a way that when the locking lever 66 is swivelled in the direction of the arrow 68, the holder 54 is displaced in such a way that the tension pulley 52 is moved away from the rollers 7 and 8. At the same time, the lift-off roll 105 is also moved so as to force the drive belt away from the rollers. The swivelling of the locking lever 66 in the direction of the arrow 68 takes place by means of a potential energy source that is shown as leaf spring 75. One end of the leaf spring contacts the locking lever 66 and the other end is fixed to the machine frame 77 by means of screws 76. The locking lever 66 is in its locking position when the tension strip 72 is slack and the leaf spring 75 is deformed. At this point the biased lever is secured by a locking device comprising an electric switching magnet 63 that is fastened to a part 102 of the machine frame 77, and a piston 64 which, when actuated, can be withdrawn transversely to the direction of motion of the locking lever 66. The piston 64 acts as a switching bolt which projects into the path of motion of the locking lever 66 which, at this point, is provided with a limit stop formed by a rotatable roll 65. When the switching magnet 63 is actuated the switching bolt 64 is withdrawn from the area of the roll 65 so that the biased locking lever 66, under the force of the deformed leaf spring 75, is swivelled into the direction of the arrow 68. As a result, the tension strip 72 displaces the holder 54 in a direction such that the tension pulley 52 is moved away from the belt 24 and rollers 7 and 8. At the same time, the lift-off roll 105 is displaced so as to lift the tangential belt 24 off the rollers. For this purpose, the leaf spring 75 used as the potential energy source must be constructed in such a way that it is stronger than the spring holding the tension pulley 52 in the operational position. Reengaging of the drive of the rollers 7 and 8 can occur only when the locking lever 66 is returned into its operational position by deforming the leaf spring. The switching piston 64 of the switching magnet 63 then again supports the locking lever 66 by reaching under the roll 65. It may be provided that the switching piston 64 by means of a spring inside of the switching magnet 63, is held in its extended position and provided on one side with a stopping bevel for the roll 65. In this manner the roll 65 can press this switching piston 64 into its locking position when the locking lever 66 is returned to its locking position.

Subsequently the switching piston moves out again because of the effect of the spring and returns to the locking position when the roll 65 has passed. The opening of the locking device, through the actuating of the switching magnet 63, is controlled by the yarn guard 59 which is connected with switching magnet 63 by means of connection 62. Advantageously an electric control may be connected in series to the switching magnet 63 in such a way that it is activated only briefly when a yarn breakage occurs and then again returns to its locking position wherein the switching piston 64 is extended. Since the conditions for the opening of the coupling 42 differ from the conditions for the actuation of the switching magnet 63, it may under certain circumstances, be useful to provide a separate yarn guard for the switching magnet 63. This is indicated in FIG. 3 as a yarn guard 80 drawn in dash-dotted form in front of the withdrawal means 11 and 12, said yarn guard 80, connected with the switching magnet 63 by means of a line 81.

As shown in FIGS. 3 and 4, one valve 55 is arranged in each of the vacuum pipes 31 of the spinning units 1, said valve 55 being provided with a slide 56 held in its open position by means of a spring 58. The slide 56 is provided with an actuating piston 57 located in the path of movement of a projection 114 of the locking lever 66 which, by means of a thrust piece 70, is located opposite the actuating piston 57. The valve 55 is arranged in such a way that, when the locking device is opened and the locking lever 66 is swivelled in the direction of the arrow 68, the valve 55 is closed so that the vacuum effect in the area of the suction inserts 20 and 21 of the rollers 7 and 8 is interrupted.

The restarting of the spinning unit 1 takes place via the servicing apparatus 16 that can be moved in a longitudinal direction relative to the machine, said servicing apparatus 16 being applied to the respective spinning unit 1. The servicing apparatus 16 first brings the locking lever 66 back into its operational position, which causes, the valve 55 to open again. The free end 71 of the locking lever 66 projects out of the front side of the spinning unit 1 through the housing part 18 or a covering by means of opening 106. End 71 is lifted by a lever 87 that can be driven by an actuating drive that is not shown. The lever 87, by means of a roll 86, is positioned below the free end 71 of the locking lever 66 and lift end 71 by displacement in the direction of the Arrow 88 as shown in FIG. 3. After the switching bolt 64 of the switching magnet 63 has withdrawn behind the roll 65, the swivel arm 87 is moved back corresponding to the direction of the arrow 89. The holder 54, by means of an arm 79, projects through an opening 107 at the front side of the spinning unit 1. A control element 90 of the servicing apparatus 16 can be moved out corresponding to the direction of the arrows 91 and 92 and be applied to said holder 54. By moving the control element 90 in a direction indicated by arrow 91, the holder 54 is pressed back into its inoperative position, i.e., the tension pulley 52 is moved away from the rollers 7 and 8, and the tangential belt 24 is lifted off by means of the lift-off roll 105. In the process the tension strip 72 representing the transmission mechanism between the locking lever 66 and the holder 54 is slackened more, without any movement of the locking lever 66.

The servicing apparatus 16 is also provided with an auxiliary drive for the rollers 7 and 8 which contains a friction wheel 109 that can be applied to the area of the wedge-shaped gap 9 of the rollers 7 and 8. This friction wheel 109 is applied in the area of a recess 108 of the housing part 18 which is preferably opposite the area in which the tangential belt 24 is applied against the surfaces of the rollers 7 and 8. The friction wheel 109 can be driven out on a holder 113 in the direction of the arrows 110 and 111. Through a synchronous belt drive or chain drive 112, the wheel 109 is driven by a preferably continuously controllable motor of the servicing apparatus 16. The servicing apparatus 16 is also provided with an auxiliary drive for the feeding roller 4. As an axial extension, the feeding roller 4 is provided with a pulling cone 46 on which a slaving piece 82 with a correspondingly profiled recess 83 can be fitted. This slaving piece 82 is arranged in the servicing apparatus 16 so that it can be displaced in the direction of the arrows 84 and 85 and can be driven on a shaft by a preferably continuous controllable motor of the servicing apparatus 16.

In order to be able to control the suction effect during the yarn piecing process, the valve 55 can be provided with an electric control element such as a switching magnet by means of which the slide 56 can be moved into suitable intermediate positions for adjusting the suction effect. The actuating of this electric control element, for example an inductive control element, can then take place through a suitable electric switching connection on the servicing apparatus 16. Preferably, the servicing apparatus 16 is also provided with devices that replace the withdrawal means 11 and 12 during the piecing process and that control the winding onto the spool before the pieced yarn is returned to the spinning unit 1.

Figure 5:
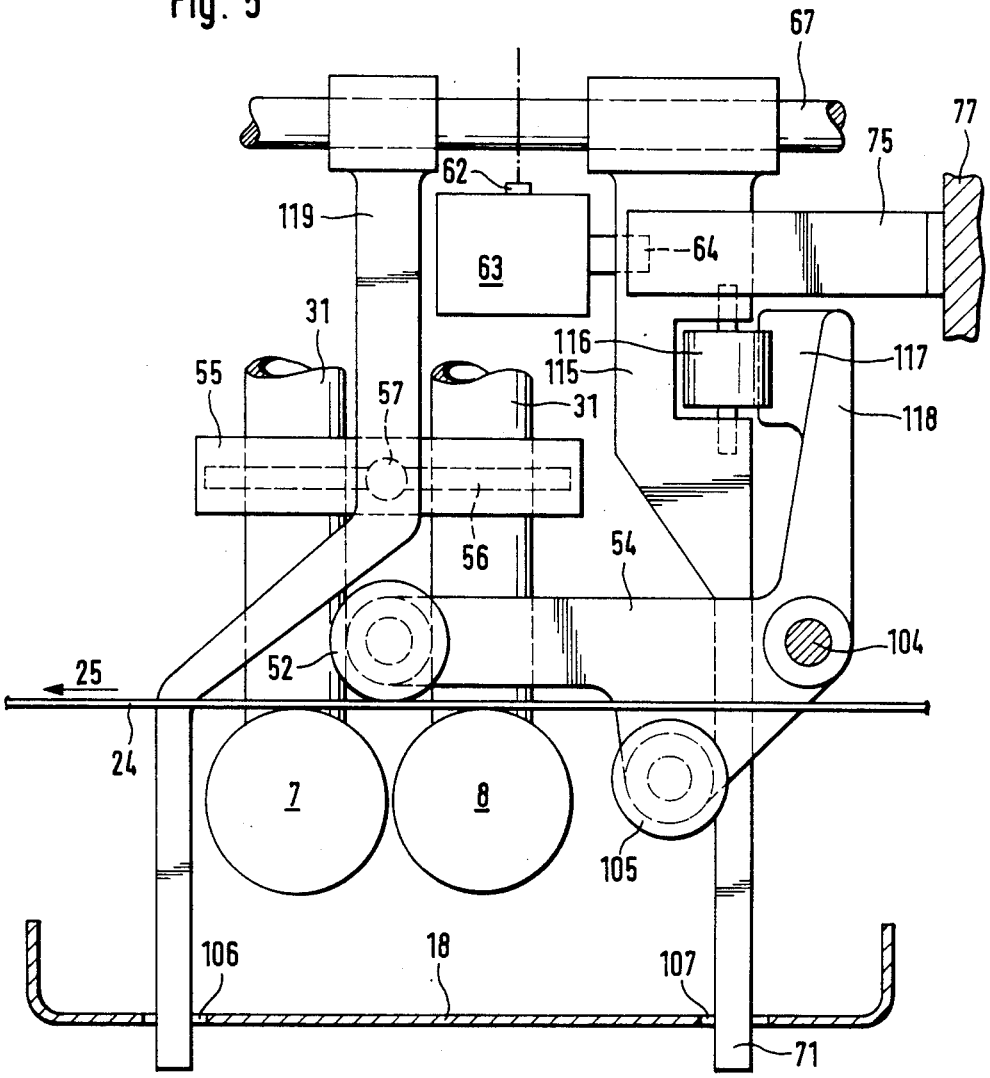
FIG. 5 is a top view that is similar to FIG. 4 of another embodiment of a spinning unit and servicing arrangement constructed in accordance with the present invention.

The embodiment according to FIG. 5 differs from the previously described embodiment in that a different transmission mechanism is employed for connecting the holder 54 of the tension pulley 52 and the lift-off roll 105 with the biased locking lever 115. The locking lever 115, corresponding to the locking lever 66 of the embodiment according to FIG. 3 and 4, can be swivelled around a shaft 67 extending in a longitudinal direction relative to the machine. Its locking position is secured by a switching magnet 63 having a retractable switching piston 64 which may be located in the path of movement of the locking lever 115, thereby securing the biased locking lever in the operational position or locking position. The locking lever 115 is loaded by means of a leaf spring 75 which is deformed in the locking position and serves as a potential energy source. The holder 54 is provided with a lever arm 118 having a stop bevel 117 projecting diagonally into the path of movement of the locking lever 115, said locking lever being provided with a stop roll 116. In the locking position of the locking lever 115, the stop roll 116 is free of the stop surface 117 of the holder 54 that is forced into the operational position by means of a spring that is not shown. After the locking device 63 is opened, the stop roll 116 contacts the stop bevel 117 and due to the force exerted by the leaf spring 75, the holder 54 through its lever arm 118 is forced into the inoperative position. In this embodiment, the valve 55 is not actuated in the vacuum pipes 31 leading to the suction inserts of the rollers 7 and 8 and accordingly the control element 90 of the servicing apparatus 16 is not necessary. The locking lever 115 will be returned to its operational position only when the operational drive of the spinning unit 1 is to be switched on again in which case the tension pulley 52 and the tangential belt 24 moves back into the operational position. In this embodiment, the valve 55 arranged in the vaccum pipes 31 is actuated through a separate actuating lever 119 by the servicing apparatus 16. The actuating lever 119 may be swivelled around the swivel shaft 67 and placed on the actuating piston 57 of the slide 56 of the valve 55. The actuating lever 119, with its free end, projects outwardly from the front side of the spinning unit 1. Naturally, in this case also, an electric control element can be provided for actuating the slide 56 of the valve 55, which will then correspondingly be switched via electric means by a servicing apparatus 16.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An open end friction spinning apparatus comprising:

a plurality of spinning units, each said unit comprising two friction rollers arranged adjacent to one another to form a wedge-shaped yarn-forming gap therebetween;

common drive means engaging a plurality of said spinning units, wherein said common drive means comprises belt drive means;

at least one rotatable spring loaded tension pulley means associated with each spinning unit for engaging said belt drive means, said pulley means causing said drive belt means to engage said rollers, and automatic disengaging means for disengaging each said tension pulley means from said belt drive means thereby disengaging said belt means from said roller means.

2. Apparatus according to claim 1, wherein sensing means are provided for sensing yarn breakage and control means are provided for actuating said automatic disengaging means upon receipt of a signal from said sensing means.

3. Apparatus according to claim 1, wherein said automatic disengaging means comprises biased locking lever means, automatically controlled locking means for selectively preventing movement of said biased lever means, and means for displacing said tension pulley means in response to movement of said locking lever means.

4. Apparatus according to claim 3, wherein said locking means comprises retractable bolt means.

5. Apparatus according to claim 3, wherein said biased locking lever means is spring biased.

6. Apparatus according to claim 4, wherein said retractable bolt means is controlled by magnetic switching means.

7. Apparatus according to claim 3, wherein said means for displacing said tension pulley means comprises displacable support means for said pulley means and means for connecting said support means with said locking lever means.

8. Apparatus according to claim 1, wherein the axis of rotation of said rotatable pulley means is parallel to the axes of rotation of said rollers, said axis of rotation located in the plane cotangent with said rollers and bisecting a wedge-shaped gap between said rollers.

9. Apparatus according to claim 7, wherein said displacable support means is provided with lift-off roll means for lifting said belt drive means away from said roller means.

10. Apparatus according to claim 3, wherein each said spinning unit is provided with suction means for drawing fibers into a wedge-shaped gap between said rollers, said suction means being provided with valve means for controlling said suction means.

11. Apparatus according to claim 10, wherein sensing means are provided for sensing yarn breakage and control means are provided for causing said valve means to shut off said suction means upon receipt of a signal from said sensing means.

12. Apparatus according to claim 10, wherein said valve means are provided with control means responsive to movement of said locking lever means, said control means causing said valve means to shut off said suction means upon movement of said locking lever means.

13. Apparatus according to claim 3, further comprising movable servicing means for selectively servicing each of said spinning units, said servicing mean containing means for returning said locking lever means to a position wherein movement is prevented by said locking means after automatic disengagement of said tension pulley means.

14. Apparatus according to claim 13, wherein said servicing means is provided with means for selectively disengaging said drive belt means from each of said spinning units.

15. Apparatus according to claim 13, wherein said servicing means is provided with auxiliary drive means for driving said rollers independently of said common drive means.

16. Apparatus according to claim 10, further comprising movable servicing means for selectively servicing each of said spinning units, said servicing means being provided with means for actuating said valve means.

17. Apparatus according to claim 3, further comprising feed roller means for feeding a sliver to said two rollers arranged adjacent one another and servicing means for selectively servicing each of said spinning units, said servicing means being provided with auxiliary drive means for driving said feed roller means.

18. Apparatus according to claim 17, further comprising opening roller means for opening up a sliver into individual fibers, said opening roller means receiving a sliver from said feed roller means, said servicing means being provided with auxiliary drive means for driving said opening roller means.

19. Apparatus according to claim 18, wherein each spinning unit is provided with fiber feeding channel means disposed between said opening roller means and said two rollers arranged adjacent to one another for directing fiber to said two adjacent rollers from said opening roller means, said fiber feeding means being provided with suction duct means disposed in a portion of said fiber feeding channel means adjacent said two rollers arranged adjacent to one another.

20. Apparatus according to claim 19, wherein said servicing means is provided with suction connection means for connecting a vacuum source with said suction means.

* * * * *